US006401706B1

(12) United States Patent
Hernblom et al.

(10) Patent No.: US 6,401,706 B1
(45) Date of Patent: Jun. 11, 2002

(54) FOLDABLE AND TRANSPORTABLE STONE CUTTING SYSTEM

(75) Inventors: Gerald D. Hernblom; Steven D. Innes, both of Loveland, CO (US)

(73) Assignee: Cee Jay Tool, Inc., Loveland, CO (US)

( * ) Notice: Subject to any disclaimer, the term of this patent is extended or adjusted under 35 U.S.C. 154(b) by 0 days.

(21) Appl. No.: 09/426,541

(22) Filed: Oct. 25, 1999

(51) Int. Cl.[7] ..... B28D 1/26
(52) U.S. Cl. ..... 125/23.01; 125/35
(58) Field of Search ..... 125/23.01, 35; 451/356

(56) References Cited

U.S. PATENT DOCUMENTS

| | | | | |
|---|---|---|---|---|
| 125,804 | A | 4/1872 | Gear | |
| 156,274 | A | 8/1874 | Brooks | |
| 247,569 | A | 9/1881 | Maxim | |
| 332,999 | A | 12/1885 | Donnelly | |
| 541,823 | A | 6/1895 | Bair et al. | |
| 600,856 | A | 3/1898 | Brinkman | |
| 624,581 | A | 5/1899 | Travaglini | |
| 749,937 | A | 1/1904 | Lanigan | |
| 812,973 | A | 2/1906 | Barr et al. | |
| 957,747 | A | 5/1910 | Clifton | |
| 1,084,827 | A | 1/1914 | Sudre | |
| 1,094,177 | A | 4/1914 | Sudre | |
| 1,487,595 | A | 3/1924 | Petermann | |
| 1,541,078 | A | 6/1925 | Sudweeks | |
| 1,723,112 | A | 8/1929 | Wolever | |
| 1,796,995 | A | 3/1931 | Katterjohn | |
| 1,799,173 | A | 4/1931 | Lindsay | |
| 1,919,800 | A | 7/1933 | Newsom | |
| 1,919,801 | A | 7/1933 | Newsom | |
| 2,138,767 | A | 11/1938 | Matthews | 251/91 |
| 2,153,193 | A | 3/1939 | Johanning | 125/23 |
| 2,187,299 | A | 1/1940 | Burkhardt | 125/13 |
| 2,188,318 | A | 1/1940 | Siderits | 135/23 |

(List continued on next page.)

FOREIGN PATENT DOCUMENTS

| | | | |
|---|---|---|---|
| GB | 2188865 | * 10/1987 | 125/23.01 |

OTHER PUBLICATIONS

"Hutton Stone Cutters, Inc., Turning Boulders into Walls.", Hutton Stone Cutters, Inc. brochure, 1996., two pages.

"E–Z Split Hydraulically Operated Stone Splitter", Park Industries, Inc., brochure, two pages.

"Porta Cut", Vinci Machine Systems, Inc. brochure, two pages.

*Primary Examiner*—Robert A. Rose
(74) *Attorney, Agent, or Firm*—Santangelo Law Offices, P.C.

(57) ABSTRACT

A foldable and transportable stone cutting system has been invented for cutting and shaping stones in a field, construction sites and the like, among others. The stone cutter system is so designed that a major cutting portion, e.g., the upper guillotine element, may be folded down during a transportation process. This improved stone cutter system has made a remote or on-site construction work more feasible and at the same time has enhanced its safety during its transportation because of its foldability. This foldable and transportable stone cutting system possesses the towable characteristics needed and the needed safety features. Relevant methods and other disclosures on how the system works and how the unique design has achieved folding capability and towability are also discussed.

26 Claims, 7 Drawing Sheets

U.S. PATENT DOCUMENTS

| | | | | |
|---|---|---|---|---|
| 2,205,313 | A | 6/1940 | Stahl | 125/23 |
| 2,278,713 | A | 4/1942 | Riddle | 164/56 |
| 2,319,154 | A | 5/1943 | Orlow | 125/23 |
| 2,382,257 | A | 8/1945 | Ramsay | 51/3 |
| 2,452,706 | A | 11/1948 | White | 125/23 |
| 2,453,216 | A | 11/1948 | Graham et al. | 125/23 |
| 2,514,352 | A | 6/1950 | Solomito | 125/23 |
| 2,523,601 | A | 9/1950 | Swift | 125/23 |
| 2,552,958 | A | 5/1951 | Graham et al. | 125/23 |
| 2,557,098 | A | 6/1951 | Graham et al. | 125/23 |
| 2,570,700 | A | 10/1951 | Marcerou | 125/13 |
| 2,580,553 | A | 1/1952 | King | 277/3 |
| 2,582,694 | A | 1/1952 | Gundlach | 125/23 |
| 2,593,606 | A | 4/1952 | Price | 125/23 |
| 2,613,661 | A | 10/1952 | Huber | 125/23 |
| 2,627,640 | A | 2/1953 | Garnich | 25/1 |
| 2,653,594 | A | 9/1953 | Findley | 125/23 |
| 2,657,681 | A | 11/1953 | Gatzke | 125/23 |
| 2,710,608 | A | 6/1955 | Huber | 125/23 |
| 2,723,657 | A | 11/1955 | Jones | 125/23 |
| 2,746,447 | A | 5/1956 | Petch | 125/23 |
| 2,753,861 | A | 7/1956 | Bode | 125/23 |
| 2,762,359 | A | 9/1956 | Entz | 125/23 |
| 2,768,620 | A | 10/1956 | Jenkins et al. | 125/23 |
| 2,777,438 | A | 1/1957 | Mangis | 125/23 |
| 2,778,354 | A | 1/1957 | Crowl | 125/23 |
| 2,779,324 | A | 1/1957 | Schlough et al. | 125/23 |
| 2,795,222 | A | 6/1957 | Garrison | 125/21 |
| 2,798,475 | A | 7/1957 | Van Hoose | 125/23 |
| 2,808,822 | A | 10/1957 | Celapino | 125/23 |
| 2,819,710 | A | 1/1958 | Mangis | 125/23 |
| 2,867,205 | A | 1/1959 | Vesper | 125/23 |
| 2,874,688 | A | 2/1959 | Biesanz, Sr. et al. | 125/23 |
| 2,881,753 | A | 4/1959 | Entz | 125/23 |
| 2,882,888 | A | 4/1959 | Saloga | 125/23 |
| 2,888,915 | A | 6/1959 | Entz et al. | 125/23 |
| 2,896,605 | A | 7/1959 | Thompson | 125/16 |
| 2,912,970 | A | 11/1959 | Schlough et al. | 125/23 |
| 2,933,079 | A | 4/1960 | Gutting | 125/23 |
| 2,950,710 | A | 8/1960 | Lenhart | 125/23 |
| 2,974,661 | A | 3/1961 | Mayer | 125/23 |
| 3,095,868 | A | 7/1963 | Mangis | 125/23 |
| 3,098,476 | A | 7/1963 | Mayer | 125/23 |
| 3,100,481 | A | 8/1963 | Stefanick | 125/23 |
| 3,110,579 | A | 11/1963 | Benson et al. | 51/293 |
| 3,120,842 | A | 2/1964 | Cox et al. | 125/23 |
| 3,136,193 | A | 6/1964 | Gantz | 83/380 |
| 3,297,015 | A | 1/1967 | Crawford | 125/23 |
| 3,424,144 | A | 1/1969 | Giconi | 125/23 |
| 3,451,386 | A | 6/1969 | Naito et al. | 125/13 |
| 3,491,643 | A | 1/1970 | Meinholdt | 83/625 |
| 3,559,631 | A | 2/1971 | Mangis | 125/23 |
| 3,675,972 | A | 7/1972 | Slomito | 299/41 |
| 3,677,258 | A | 7/1972 | Fletcher et al. | 125/23 C |
| 3,692,370 | A | 9/1972 | Hasz | 308/1 |
| 3,756,216 | A | 9/1973 | Fletcher et al. | 125/23 C |
| 3,809,049 | A | 5/1974 | Fletcher et al. | 125/23 C |
| 3,820,426 | A | 6/1974 | Thompson | 83/13 |
| 3,886,927 | A | 6/1975 | Chattin | 125/23 |
| 3,976,045 | A | 8/1976 | Coggins, Jr. | 125/12 |
| 3,978,842 | A | 9/1976 | Coffman | 125/23 R |
| 4,136,593 | A | 1/1979 | Short | 83/624 |
| 4,203,414 | A | 5/1980 | McCain | 125/23 |
| 4,541,405 | A | 9/1985 | Schlough | 125/23 R |
| 4,696,213 | A | 9/1987 | Conneally | 83/438 |
| 5,169,045 | A | 12/1992 | Liu | 225/96.5 |
| 5,598,832 | A | 2/1997 | Aoki | 125/23.01 |
| 5,662,094 | A | 9/1997 | Giacomelli | 125/23.01 |
| 5,779,527 | A | 7/1998 | Maebashi | 451/328 |

* cited by examiner

FOLDABLE AND TRANSPORTABLE STONE CUTTING SYSTEM

BACKGROUND OF THE INVENTION

Generally, this invention relates to a stone cutter system. Specifically, this invention focuses upon a transportable stone cutter system for cutting and shaping stones in the field, at a construction site and the like, among others. For this purpose, the stone cutter system is so designed that it may be folded down during a transportation process. This improved stone cutter system makes remote or on-site construction work more feasible and, at the same time, enhances its safety during its transportation because of its foldable feature. Relevant methods disclose how the folding capability and towable characteristics are implemented.

Stone cutting machines were available a long time ago and as a matter of fact, fabrication of stone cutting machines may date back more than a hundred years ago as some of the U.S. patents show (U.S. Pat. Nos. 156,274, 332,999, 541, 823, 600,856, and 624,581). Over decades there have been fascinating developments in the fabrication of stone splitting machines. To list a few, Biesanz et al. (U.S. Pat. No. 2,874,688), designed a masonry cutter that could manually break a slab and the like by applying mechanical forces to the slab. Vesper in his design (U.S. Pat. No. 2,867,205) started to use some kind of fluid ram as a simple hydraulic pressure generator. In recent years, various stone cutter machines have been invented (U.S. Pat. Nos. 5,779,527, 5,598,832 and 5,662,094) and these machines have fully utilized mechanical, hydraulic, electrical, and other techniques available to bevel or cut or break stones and other building materials, based upon different needs. These machines each had some advantage when dealing with different materials and inventors of these machines to some degree had overcome some weakness or drawbacks in their respective machines. However, all of these machines have a common drawback, that is, they are not easily movable. This weakness highly limited the practical uses of those machines in different circumstances and, because of this limitation tremendous labor and expense may have been involved to ship materials from a raw material source, to a place where the machine was located, and then to destinations where the materials were used. As a result there has remained some practical limitations with respect to feasibility, availability and accessability of such stone cutting machines.

This is not to say, however, no stone cutters were movable. Jones in his patent (U.S. Pat. No. 2,723,657) disclosed a towable stone cutting machine. Some other companies have also attempted making some kinds of similar towable machines as shown in their company brochures (Park Industries, Inc. and Vinci Machine Systems, Inc.). These designs to some degree have overcome some of the existing problems that prior stone cutters had. The stone cutting machine in Jones' patent provided a portable machine in which the cutting machine appeared to set on a four-wheeled trailer. However, because of its height and size, and because of its unfoldability, this machine seems to raise some safety concerns during its transportation. In addition, the machine had to be loaded down onto the ground before it could be used. In a field condition where the ground may not be a planar surface and, in a worse case scenario, the ground has a slope, such a machine may experience limitations that result from its inherent design.

Schlough in his patent (U.S. Pat. No. 4,541,405) described a "tiltable" stone shaping machine. The tiltable feature described was basically for shaping a piece of stone at a tilted angle to achieve a certain shaped stone. However, although the cutting portion of the tiltable machine can be pivotally tilted to a limited degree, it has nothing to do with a safety consideration. In addition, this machine appears to be designed so as to definitely not be portable. Therefore, it teaches away from the direction the present invention heads to improve such safety aspects on a portable stone cutting machine.

Another towable stone cutter machine is a stone splitting machine designed by Hutton Stone Cutters, Inc. (refer to the company brochure). This stone cutter machine has accomplished a more feasible design for the machine to be both towable and, at the same time, be laid down during its transportation. However, this design has drawbacks. First, obviously, this machine lacks safety features. The machine is not electrically connected to an automobile that supplies a towing force and, therefore, there is no brake system and safety tail lights. The machine frame is in an overhang position during its transportation, and that may result in a severe accident. Secondly, since the set up process needs to be done manually, it is in fact not conveniently designed. Thirdly, since the machine is designed as a small machine type, it can be only used for small stones and building materials.

Conventional methods as to how to provide a towable stone cutter and at the same time to lower the safety risks have not been successfully presented for such existing problems. Some critical aspects remain to be dealt with and improved. As those skilled in the art may readily understand, basically, to achieve maximum usage of a stone cutter for different sized and different shaped stones and building materials, the stone cutter may have to maintain a minimum height and a comparatively larger supporting frame and overall size. On the other hand, to achieve a safer transportation goal, the stone cutter may have to be kept as low and as small as possible. Such a dilemma has been existing for a long time. None of the available stone cutters have the desired towable characteristics and safety features.

Based on the above analysis, it appears that there has been a long felt but unsatisfied need for the invention while the needed implementing arts and elements have long been available. What appears to be an urgent need in the field of stone cutting machines would be a machine with a higher capability and a higher cutting power that satisfies the convenient feature for users, and is towable so the users can use it anywhere they want. At the same time, the machine would have all the necessary safety characteristics that are vital for transportation. Although there have been many stone cutting machines designed, patented and fabricated, appreciation that such a problem existed and what the problem was appears to have been unseen by those skilled in the art.

It may also appear that there may have been substantial attempts by those skilled in the art to fill the need for a towable machine with highly safe features for transportation or to cope with the difficulties in the past. However, those attempts did not succeed, perhaps because of a failure to understand what the problem truly was. The available art in the field has thus taught away from the technical direction in which the patentee went.

On the other hand, as for the present invention, the inventors have identified the problem in the field and have so designed a stone cutting system that has filled the needs practically and has solved many of the difficulties that the prior art faced. That appropriate practical designs have been selected is perhaps evidenced by the fact that even in its early stages of sales, this design has achieved significant commercial success as a result of the invention itself, not because of extensive advertising or the like. This invention advances over the prior art and it is not just a gradual slope of improvement. In fact, until the present invention, there has been no such stone cutting machine that appropriately filled the needs as described above.

SUMMARY OF THE INVENTION

Accordingly, the present invention provides a commercially valuable stone cutting system, which is foldable and safely transportable. Specifically, this invention provides a foldable and transportable stone cutter system for use in the field, at a construction site, and the like.

It is an object of the present invention to create a safely towable stone cutting system. To achieve this goal, this system is so designed that, first of all, its overall shape and weight are reduced but its cutting power remains unchanged, when compared to other available similar stone cutters. Secondly, the foldable cutting portion of the system is conceived and made on a towable transportation system. This system comprises all the necessary towing components needed and possesses safety features.

It is another object of the present invention that the stone cutter system is so designed that it may be folded down during a transportation process. This improved stone cutter system makes remote or on-site construction work more feasible and, at the same time, has enhanced its safety during its transportation because of its foldable feature.

It is a further goal of the present invention to maximally maintain each of the machine's cutting teeth in firm contact with an irregular stone to be cut so the stone can be cut into a desired shape. That is, each of the teeth may be evenly held against the uneven surface of the stone by adjusting the relative position of each of the teeth and an elastic element such as an inbound table spring element underneath an inbound table. This goal can be achieved by introducing multiple hydraulic floating teeth and by hydraulically controlling the stone cutter system as described in this invention.

It is yet still a further object of the present invention to demonstrate relevant methods for implementing the unique design of the foldable and towable characteristics that the system possesses.

Naturally, further goals and objects of the invention are disclosed throughout other areas of the specification and claims.

BRIEF DESCRIPTION OF THE DRAWINGS

FIG. 9 is a side view showing the same embodiment as in FIGS. 7 and 8:

FIG. 10 is a side view showing the same embodiment as in FIGS. 7–9:

FIG. 11 is a fragmentary side view of the transportation system of the present invention:

DETAILED DESCRIPTION OF THE PREFERRED EMBODIMENTS

As mentioned earlier, the present invention includes a variety of components that may be used in different combinations, depending on the application that needs to be addressed. The invention is designed primarily to take advantage of towability of a particular and novel design and combine and modify it as needed for a variety of shapes, sizes, and orientations, as will be explained in more detail and as the figures describe. This invention is intended to encompass a wide variety of uses of a foldable and transportable stone cutting system for the masonry industry. Elements, functions, and procedures that distinguish the present invention are understandable and some will be noted where appropriate.

As can be easily understood, the basic concepts of the present invention may be embodied in a variety of ways. It involves both methods and devices to accomplish the appropriate method. In this patent, the methods are disclosed as part of the results shown to be achieved by the various devices described and as steps that are inherent to utilization. They are simply the natural result of utilizing the devices as intended and described. In addition, while some devices are disclosed, it should be understood that these not only accomplish certain methods, but also can be varied in many ways. Importantly, as to the foregoing, all these facets should be understood to be encompassed by this disclosure.

Figure 1:
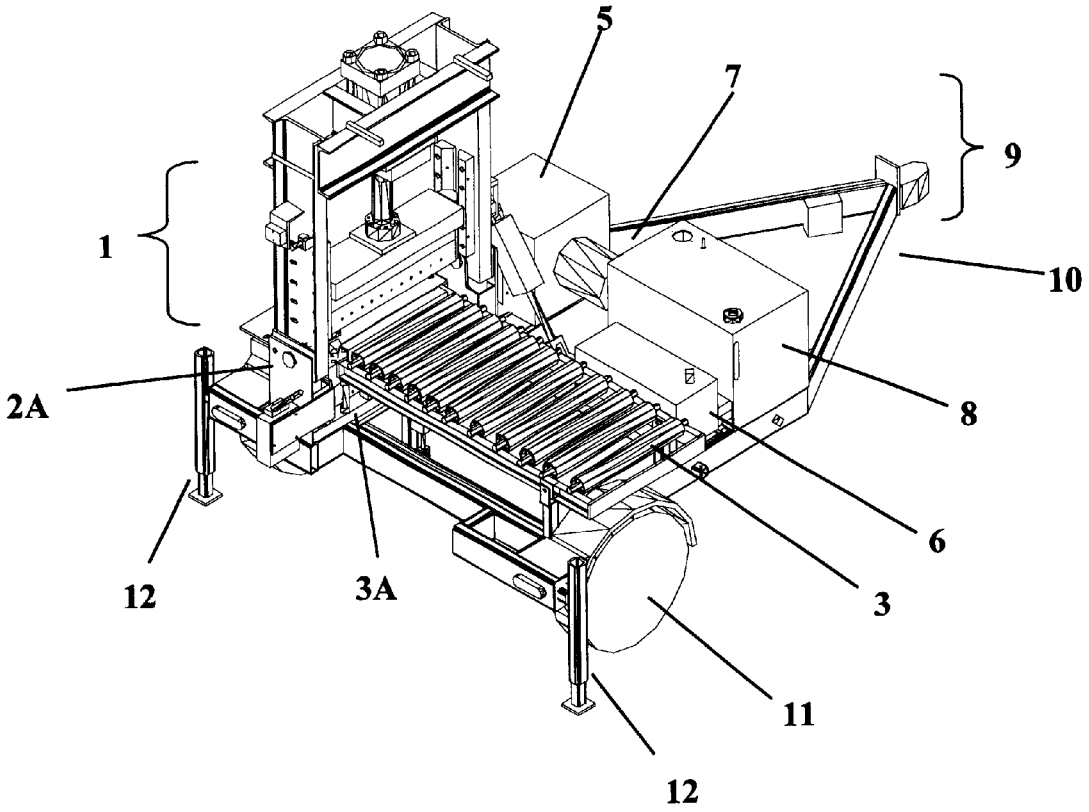
FIG. 1 is a perspective view of an embodiment of the invention showing the foldable and transportable stone cutting system.
Figure 2:
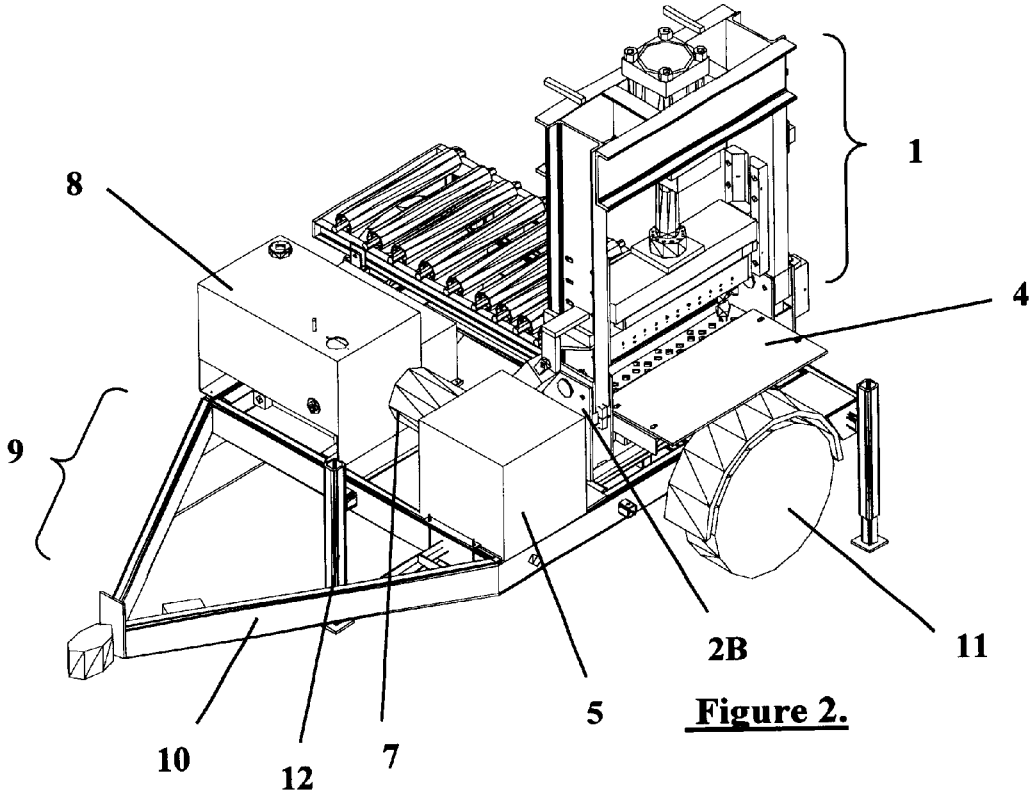
FIG. 2 is a perspective view of the embodiment of the invention showing the same system from a different angle.

Based on the foregoing, this invention discloses a transportable stone cutting system that is also foldable for transportation purposes. It can be folded down roughly in half and towed in a safe way. As shown in FIGS. 1 and 2, the foldable and transportable stone cutter system may be composed of several subunits. A foldable upper guillotine element (1) as shown is in an operational position. The foldable upper guillotine element performs the cutting function. It may be pivotally attached to a base member. The base member may comprise two pieces of perhaps vertically oriented lower supporting elements (2A and 2B) that support the foldable upper guillotine element (1). The system may also comprise a stone positioning platform and the stone positioning platform may have an inbound receiving platform (3) and an outbound receiving platform (4) which may be oriented horizontally. The inbound receiving platform may comprise an inbound table that may be made of a plurality of rollers and at least one elastic element beneath the end of the table. The elastic element may be an airbag, a hydraulic device, a spring element or any kind of suspension device or the like. One of the spring elements, referred as an inbound table spring element, is shown in FIG. 1 (3A). The rollers may be a plurality of cylinders made of metal or other hard material capable of sustaining stones. The inbound table spring element or the like may serve as a cushion to adjust the height of the inbound table, such as if a stone or a slab is in an irregular shape, to achieve the best cutting result. The out bound receiving platform may comprise an outbound table that may simply be a flat piece with a flat surface. The flat piece may be permanently fixed via some pieces under it to a base frame of a towable transportation system, as will be discussed below. The above mentioned lower supporting elements may be at a location between the inbound table and the outbound table.

The system may have a power application system and a power supply source. The power application system may range from a mere plug to more sophisticated power connections either externally or to an attached generator or the like. The power supply source may be a power generator (5) that is a part of the foldable and transportable stone cutter system or may simply be a electric source that may not be a part of the system. The power generator may be a type of an engine and, if so, the engine may be accompanied by a fuel-supplying container, or a fuel tank (6). The power generator may operate a pump (7). The pump may be a hydraulic pump or the like and may serve as a hydraulic pressure-generating device to generate hydraulic pressure. The pump may be connected to a hydraulic fluid reservoir. In this system the hydraulic fluid reservoir may be a hydraulic container, for example, a hydraulic tank (8), to serve as part of a hydraulic pressure system. The hydraulic pressure may be supplied to the foldable upper guillotine element (1) through a foldable pressure application element. The foldable pressure application element may be a foldable hose (not shown) connecting the hydraulic tank with the foldable upper guillotine element. It may power a jaw cylinder as shown below in FIG. 6.

All the above described subunits may be on a towable transportation system (9). The towable transportation system (9) may simply be a trailer with the base frame (10) as mentioned earlier, wheels (11) and other necessary accessories for towing purposes as will be described below. Since FIGS. 1 and 2 show the foldable and transportable stone cutter system in an operational mode, a portion of the whole system has been raised above ground level by a plurality of supporting elements (12). These supporting elements may comprise a plurality of stabilizing jacks so the foldable and transportable stone cutter system can be supported and stabilized at multiple locations beneath the base frame of the towable system. In one of the preferred embodiments, there may be three of these types of stabilizing jacks as shown in FIGS. 1 and 2, so that the system may be supported at three opposite locations. These stabilizing jacks may be hydraulic, electrical, or mechanical jacks, and may be repositionable when they are not in use. In this instance they may also be referred to as repositionable jacks.

Figure 3:
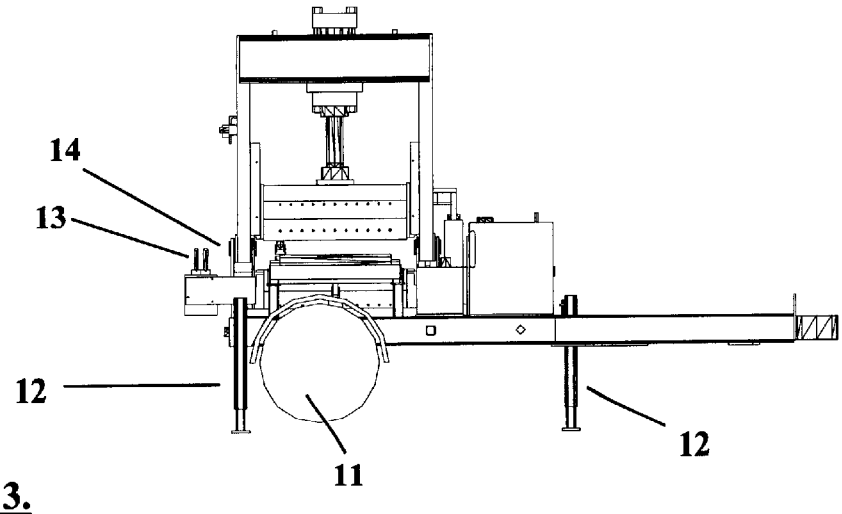
FIG. 3 is a right side view of the embodiment shown in FIGS. 1 and 2 with respect to the towing direction.
Figure 4:
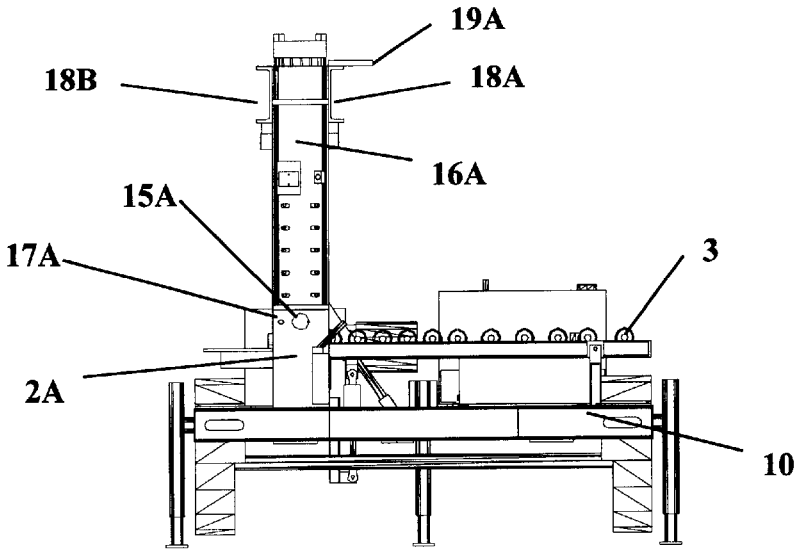
FIG. 4 is a back view of the same embodiment as shown in FIGS. 1–3.
Figure 5:
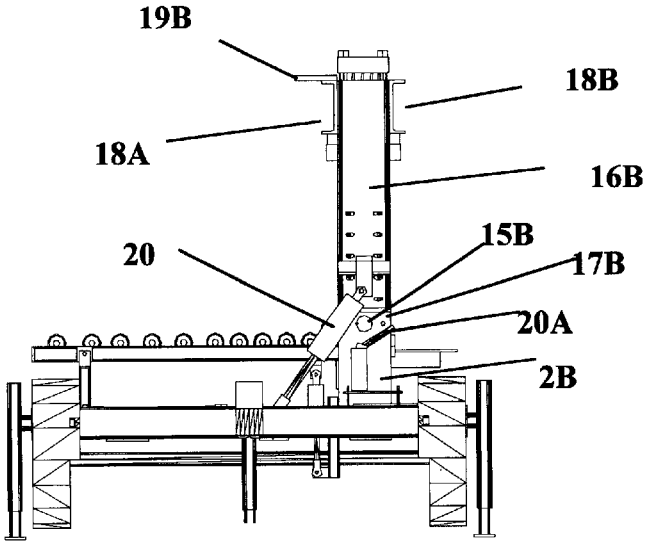
FIG. 5 is a front view of the same embodiment to illustrate the major cutting portion of the system.

FIGS. 3–5 show different perspective side views of the foldable and transportable stone cutter system. As those skilled in the art may readily understand, all figures show the system in an operational mode. FIG. 3 is a right side view of one of the preferred embodiments. As can be shown in FIG. 3, the system has been jacked up by the supporting elements. In this fashion, for example, the wheels (11) have been raised above the ground level by the stabilizing jacks (12).

On the left side of the drawing, two controlling levers are shown. One of them on the left may be a tooth control lever (13) that extends and holds multiple upper and lower cutting teeth (as will be detailed in FIG. 6) in a locking position on a stone to be cut. The other lever may be a cutting control lever (14) to operate the cutting process.

FIG. 4 is a back view from the back of the towable and transportable stone cutting system. In addition to the towable transportation system (10), FIG. 4 shows the base member (2A), e.g., the lower supporting elements, a pivot pin (15A) through which the foldable upper guillotine element (1) and the base member connects. There may be two such pivot pins and the foldable upper guillotine element (1) may pivotally fold around these two pivot pins. The foldable upper guillotine element (1) may comprise a supporting frame and the supporting frame may comprise two vertical members and two pieces of horizontal members. The two vertical members may comprise two pieces of side beams. One of the side beams (16A) is shown in FIG. 4. Beside the pivoting pin (15A) shown in FIG. 4 on the base member (2A) there may be a hole (17A) that may be aligned with a hole on the side beam (16A). These two holes may receive a locking element to lock the foldable upper guillotine element (1) in an operational position.

Also shown in FIG. 4 are the two pieces of the horizonal members that may comprise two pieces of horizontal beams in cross sections (18A and 18B) attached to said side beams at their ends. On one of the horizontal beams at least two top head supporting bars are attached. One is shown (19A). The top head supporting bars may support the foldable upper guillotine element (1) when it is folded down at a towable position above the inbound receiving platform (3). As those skilled in the art would understand, there is an angle between the foldable upper guillotine element (1) and the inbound receiving platform (3). When the foldable and transportable stone cutter system is in operation, the angle may be at about 90° for a perpendicular cut. However, the angle will become smaller than 90° when the system is folded down above the inbound receiving platform (3) for transportation. In one of the preferred embodiments, the fully folded angle may be at about 10°.

FIG. 5 is a front perspective view of the foldable and transportable stone cutter system. As can be seen, the second base member (2B) may be attached to another one of the two side beams (16B) through another pivot pin (15B). In one of the preferred embodiments, there may also be a hole (17B) on the second base member (2B) that may be aligned with a hole on the second side beam (16B). Thus, a second locking element may be needed to strengthen the locking mechanism to lock the system in position and to provide redundancy for added safety.

An important element in this system is a hydraulic folding device (20), also referred as a hydraulic unfolding device, as shown in FIG. 5. The hydraulic folding device, operated by a folding control lever (20A), may be a hydraulic folding cylinder (referred to as a "hydraulic folding cylinder" to differentiate its function only in the system, not to say that the cylinder itself folds) that controls the foldable upper guillotine element (1) to either raise it to an operational position or to fold it down to a towable (or storable) position. In either way, the hydraulic folding cylinder is controlled by the pressure generating device through the folding control lever. It is also shown in FIG. 5 that there may be an angle between the upper guillotine element and the inbound receiving platform and, when the foldable and transportable stone cutter system is at an operational position, this angle may be about 90°.

Figure 6:
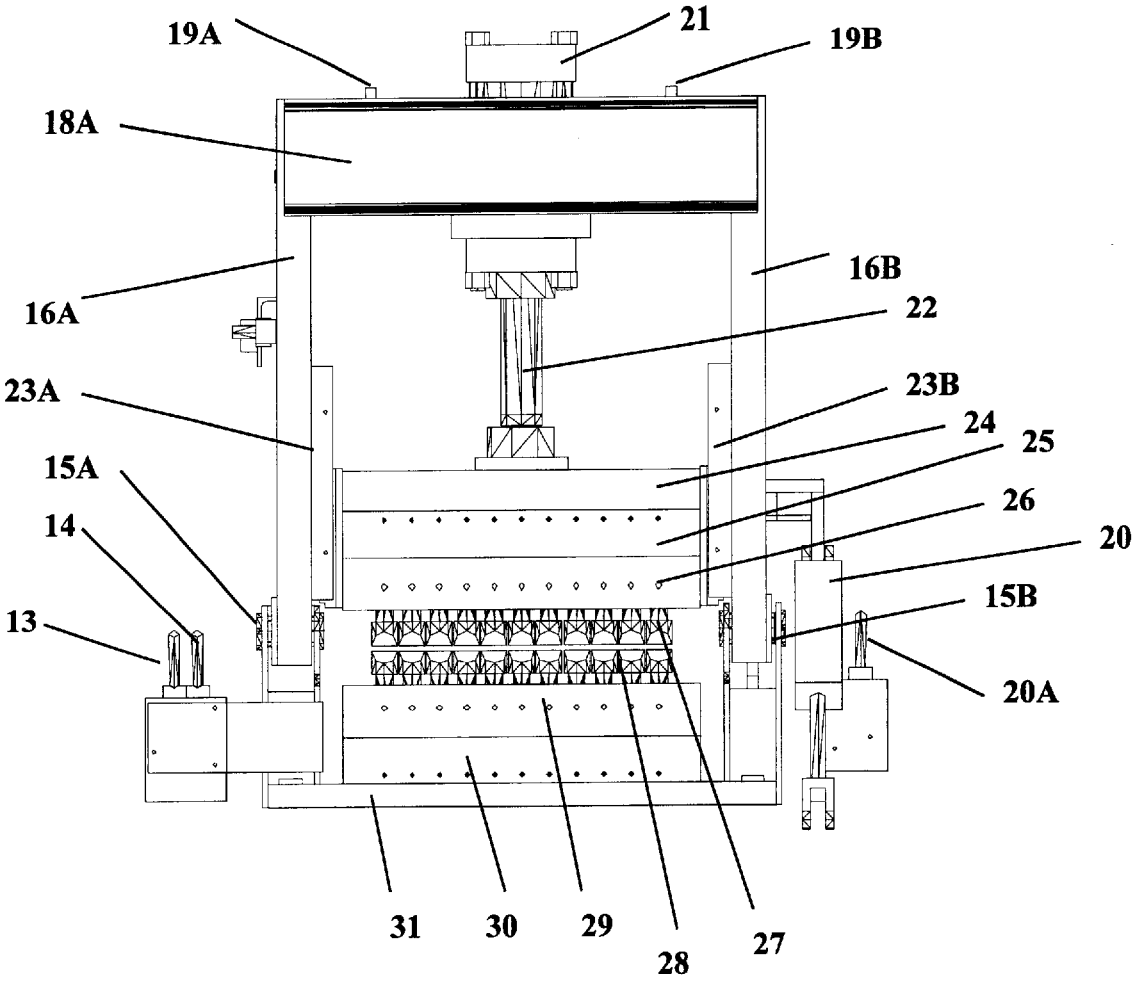
FIG. 6 is a fragmentary, right side view of the present invention showing a foldable upper guillotine element and a lower guillotine element, their respective components and their relationship.
Figure 6A:
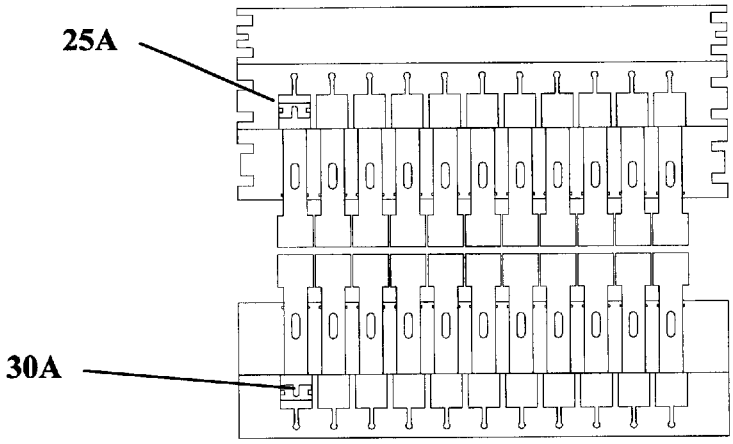
FIG. 6A is fragmentary view showing the upper and lower pistons within the upper and lower piston bars, respectively.

FIG. 6, a fragmentary, right side view, shows the major cutting portion of the foldable and transportable stone cutter system, e.g., the foldable upper guillotine element (1) and the lower guillotine element. In addition to the supporting frame that comprises two side beams (16A and 16B) and two horizontal beams (one, 18A, is shown in FIG. 6), the two top head supporting bars (19A and 19B) and two pivot pins (15A and 15B), the foldable upper guillotine element (1) may also comprise, from the top to the bottom, the jaw cylinder (21) as mentioned above, a cylinder shaft (22), two side guide assemblies (23A and 23B), an upper beam (24), an upper piston bar (25), an upper tooth bar (26) and multiple upper cutting teeth (27). The multiple upper cutting teeth (27) may be multiple hydraulic floating teeth (27). The upper beam (24), an upper piston bar (25), an upper tooth bar (26) may be collectively referred as an upper jaw. These parts may be folded down with the supporting frame. The lower guillotine element may also comprise, from the top to the bottom, multiple lower cutting teeth (28), a lower tooth bar (29), a lower piston bar (30) and a lower beam (31). The multiple lower cutting teeth (28) may be multiple hydraulic floating teeth (28). The lower tooth bar (29), lower piston bar (30), and lower beam (31) may be collectively referred as a lower jaw. The lower jaw may provide a supportive cutting force that functions together with a major cutting force, e.g., the hydraulic pressure generated from the upper jaw through the hydraulic pressure generating device, so a stone can be cut and broken at a desired location. The upper piston bar and the lower piston bar may contain multiple upper pistons (25A) and multiple lower pistons (30A), as shown in FIG. 6A, to individually operate each of the multiple upper cutting teeth and the multiple lower cutting teeth, respectively, on a stone surface. As illustrated from the cross sectional view in FIG. 6A, the upper pistons are located within the upper piston bar and the lower pistons are located within the lower piston bar, respectively.

The lower guillotine element may be fixed to the base frame of the towable transportation system (10). The upper and lower tooth bars (26, 29) may serve as carriers for the upper and lower multiple cutting teeth. The upper and lower piston bars (25, 30) may hold hydraulic fluid to operate each of the upper and lower multiple cutting teeth, to equalize each tooth and to lock the teeth in position during the cutting process. The upper and lower beams (24) may provide firm supports for the upper and lower piston bars and the upper and lower tooth bars and prevent them from deflecting. The multiple lower cutting teeth (28) may be vertically aligned with the multiple upper cutting teeth (27) when the system is in an operational position and they may be at a location between the inbound table and said outbound table, a place where the lower supporting elements are located. In one of the preferred embodiments, the folding line may be between the multiple upper cutting teeth (27) and the multiple lower cutting teeth (28).

Figure 7:
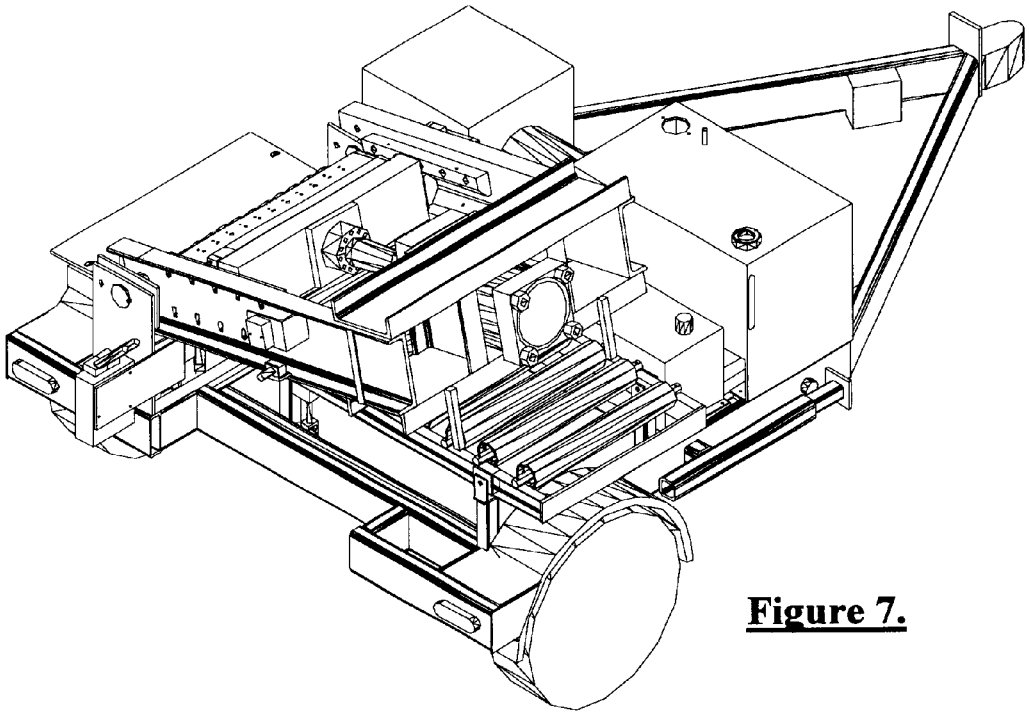
FIG. 7 is an overall, side perspective view of another embodiment of the invention showing the foldable and transportable stone cutting system in its towable position.
Figure 8:
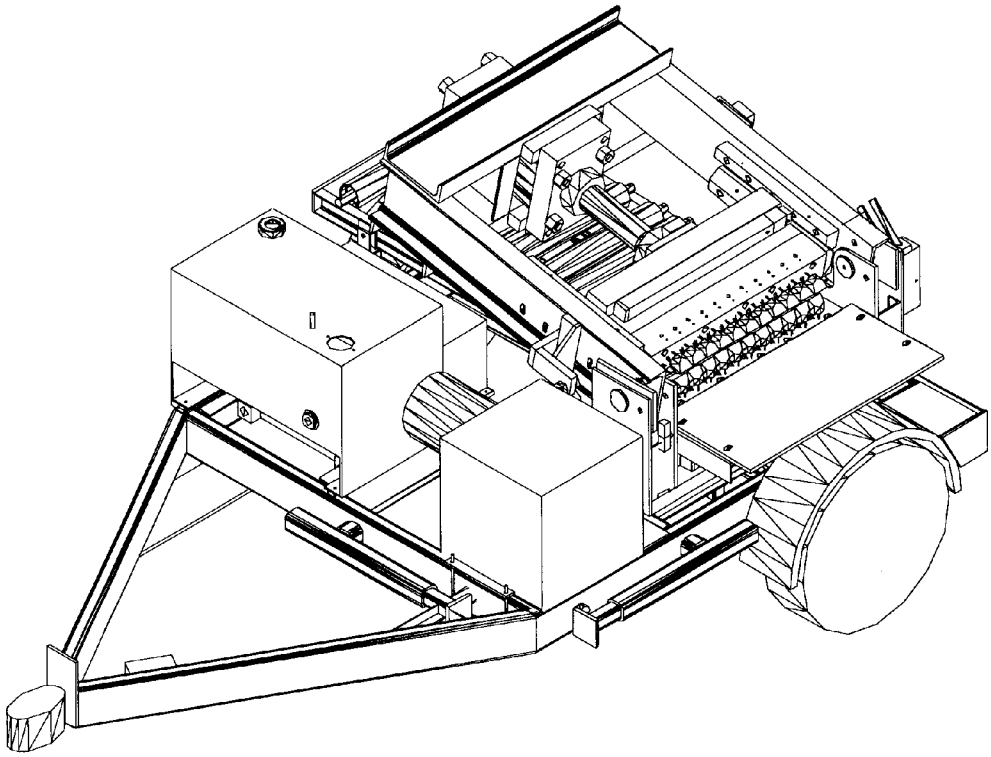
FIG. 8 is an overall, side perspective view of the same embodiment of the invention as in FIG. 7 showing, from a different angle, the foldable and transportable stone cutting system in its towable position.

The foldable and transportable stone cutter system may be converted from an operational mode to a towable mode, as shown in FIGS. 7 and 8, three-dimensional views from different angles. The foldable upper guillotine element (1) may fold down across the inbound table. This folded position has many advantages. It greatly improves the safety during transportation by lowering the center of gravity. This system has also eliminated some weak designs that appeared in other stone cutting systems such as the overhang disadvantage shown in the stone cutting machine designed by Hutton Stone Cutters, Inc. In addition, among other features for this design, the system may also comprise tail and side safety lights, a spring suspension system such as a leaf, a coil suspension system or any other kind of elastic suspension system and a safety breakaway system. Thus, this system improves the towing capability, and provides users with easy accessibility to the system. And, at the same time, it introduces the foldable feature into the system to lessen any potential safety concern during transportation. Thus, a safer towing position may be created.

Figure 9A:
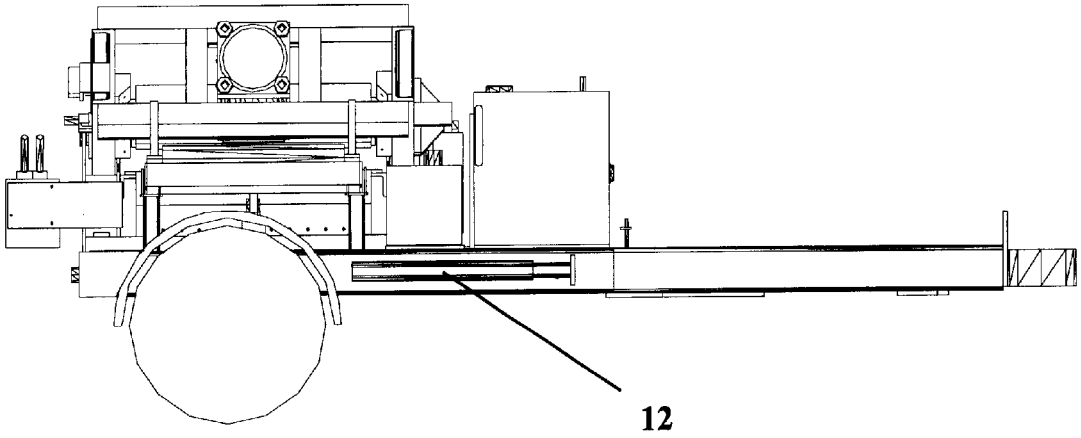
FIG. 9A, a right side view.
Figure 9B:
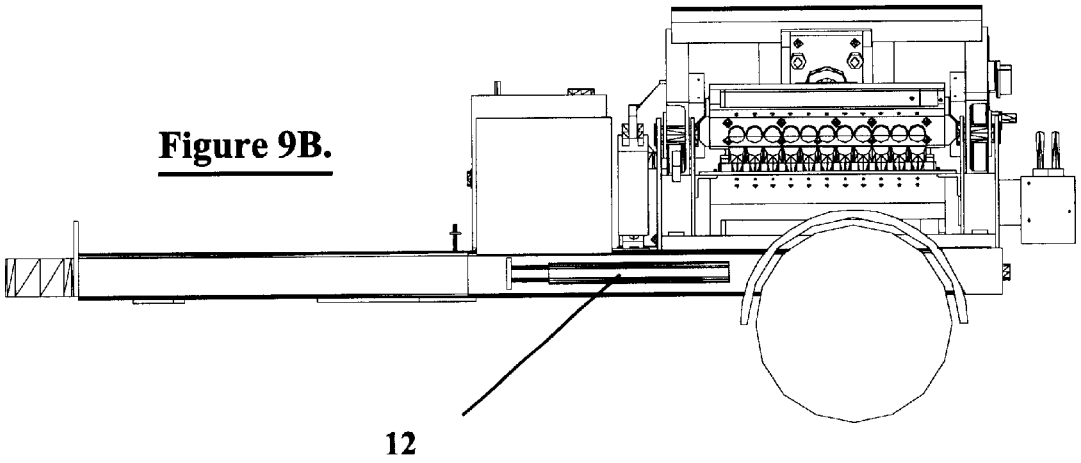
FIG. 9B, a left side view.

FIGS. 9A and 9B are side perspective views of the foldable and transportable stone cutter system in its folded down position. Two of the three re-positionable stabilizing jacks (12) are, as shown separately in FIGS. 9A and 9B, are in their towable positions.

Figure 10A:
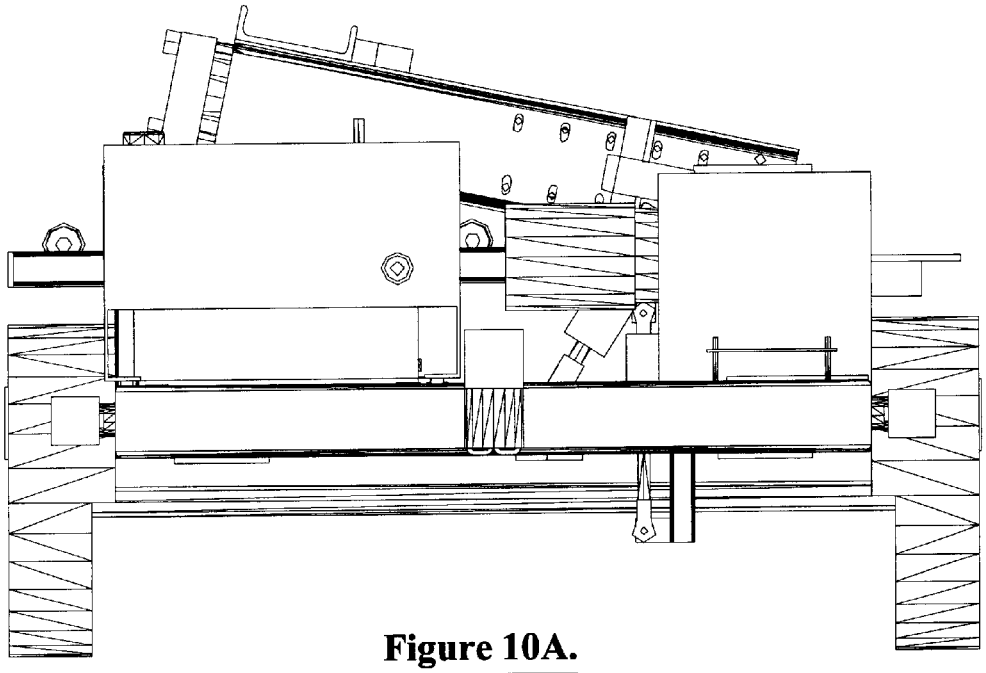
FIG. 10A, a front view.
Figure 10B:
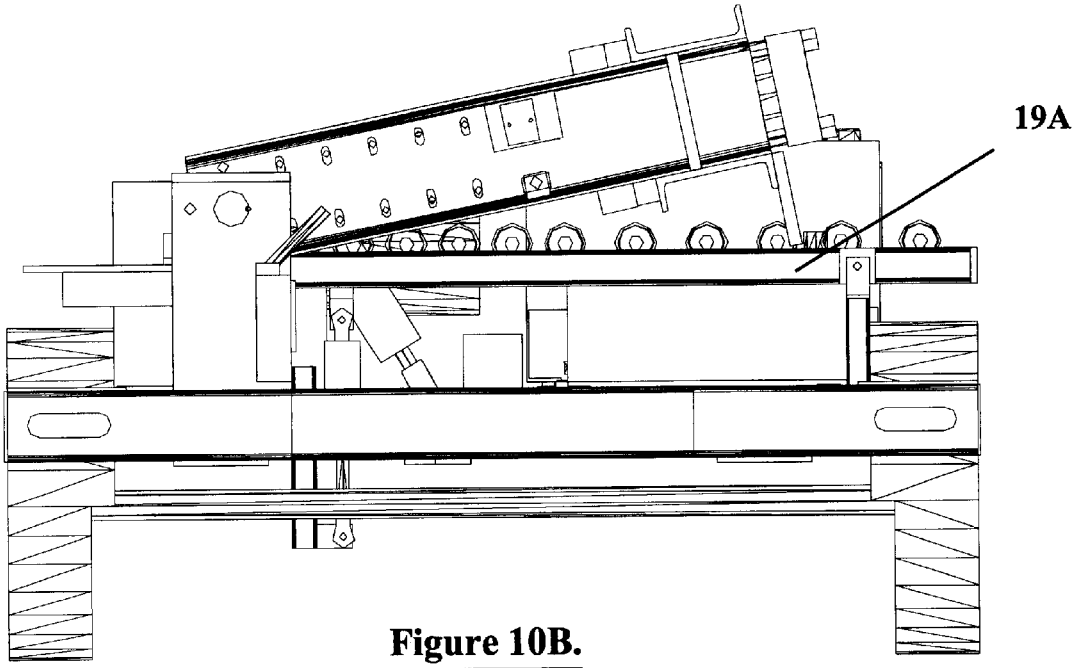
FIG. 10B, a back view.

The foldable and transportable stone cutter system can be further illustrated in its folded-down and towable position from the front view of the system as in FIG. 10A and from back view of the system as in FIG. 10B. Both the top head supporting bars are in supporting positions for the upper guillotine element. One of them can be seen in FIG. 10B. As mentioned above, there is an angle formed between the upper guillotine element and the inbound table. When the system is in the towable position, this angle may be smaller than about 90°. Most preferably it may be about 10°.

Figure 11A:
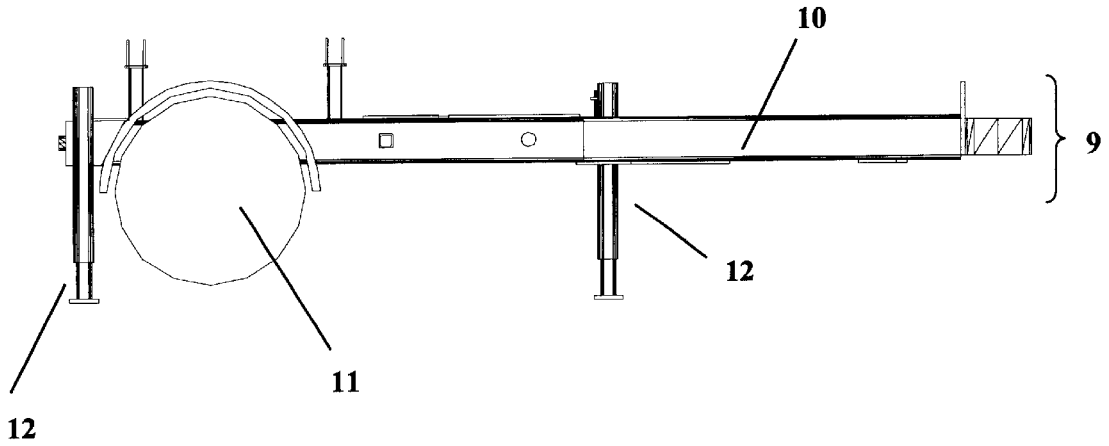
FIG. 11A is a right side view.
Figure 11B:
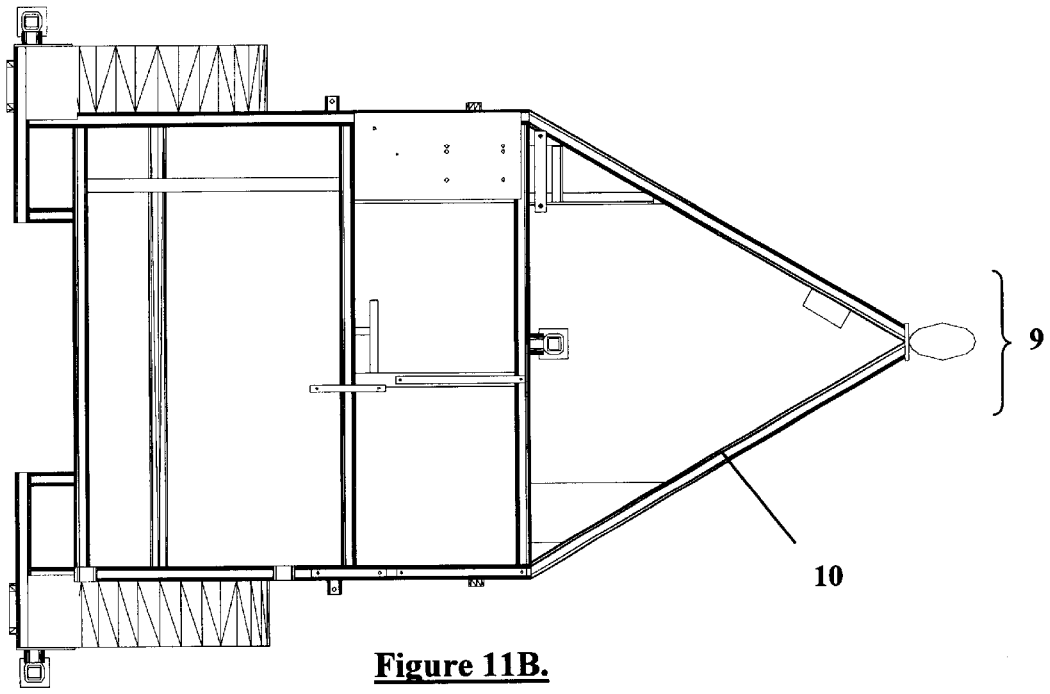
FIG. 11B is a top view.

FIGS. 11A and 11B show the towable transportation system of the foldable and transportable stone cutter system. FIG. 11A is a side view of the system and FIG. 11B is a top view. This system may simply be a trailer equipped with all necessary features including, but not limited to, tail and side safety lights, brakes, a safety breakaway system, a suspension system such as the leaf spring suspension system, a hitch element and other towing elements. The major cutting portion of the foldable and transportable stone cutter system may be fixed on this towing system.

Each of the above described embodiments could include various facets of the present invention. Some may include a power generator, while others may not include such an element. Some may include varieties of cutting means such as cutting teeth or cutting chisels to achieve maximum results depending on types of stones to be cut. The marketplace and manufacturing concerns may dictate the appropriate embodiments for the present invention.

The foregoing discussion and the claims that follow describe only the preferred embodiments of the present invention. Particularly with respect to the claims, it should be understood that a number of changes may be made without departing from the essence of the present invention. In this regard, it is intended that such changes—to the extent that they roughly achieve the same results in a similar way—will still fall within the scope of the present invention.

Although the methods related to the system are being included in various detail, only initial claims directed toward the foldable and transportable stone cutting system have been included. Naturally, those claims could have some application to the various other methods and apparatus described throughout the patent. The disclosure of the system or method context is sufficient to support the full scope of methods and apparatus claims including, for instance, the foldable upper guillotine element, the stone positioning platform, the foldable pressure application element, the lower guillotine element, the hydraulic pressure source, the hydraulic folding device, the power application system, the base member and the towable transportation system. While these may be added to explicitly include such details, the existing claims may be construed to encompass each of the other general aspects. Without limitation, the present disclosure should be construed to encompass such claims, some of which are presented in a system or method context as described above for each of the other general aspects. In addition, to the extent any revisions utilize the essence of the invention, each would naturally fall within the breadth of protection encompassed by this patent. This is particularly true for the present invention since its basic concepts and understandings may be broadly applied.

As mentioned earlier, this invention can be embodied in a variety of ways. In addition, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as an example, the disclosure of a "cutter" should be understood to encompass disclosure of the act of "cutting"—whether explicitly discussed or not—and, conversely, were there only disclosure of the act of "cutting", such a disclosure should be understood to encompass disclosure of a "cutter". Such changes and alternative terms are to be understood to be explicitly included in the description.

It is simply not practical to describe in the claims all the possible embodiments to the present invention which may be accomplished generally in keeping with the goals and objects of the present invention and this disclosure, and which may include separately or collectively alternative aspects (such as employing different cutting means and introducing such cutting means at different angles to provide multi functional uses of this system, and other aspects of the present invention). It should be understood that such aspects may be added to explicitly include such details. Furthermore, the existing claims should be construed to encompass such aspects. To the extent the methods claimed in the present invention are not further discussed, they are natural outgrowths of the system or apparatus claims. Therefore, separate and further discussion of the methods are deemed unnecessary as they otherwise claim steps that are implicit in the use and manufacture of the system or the apparatus claims. Furthermore, while the steps are organized in a more logical fashion, other sequences can and do occur. Therefore, the method claims should not be construed to include only the order of the sequence and steps presented.

Finally, any references mentioned in the application for this patent as well as all references listed in any information disclosure originally filed with the application are hereby incorporated by reference. However, to the extent statements might be considered inconsistent with the patenting of this invention, such statements are expressly not to be considered as made by the applicant.

We claim:

1. A foldable and transportable stone cutter system comprising:

a. a base member;

b. a stone positioning platform connected to said base member, wherein said stone positioning platform comprises:

i. an inbound receiving platform for a uncut stone wherein said inbound receiving platform comprises an inbound table; and ii. an out bound receiving platform next to said inbound receiving platform for a cut stone wherein said outbound receiving platform comprises an outbound table wherein said inbound table comprises at least one elastic element beneath said inbound table wherein said at least one elastic element comprises at least one inbound table spring element beneath said inbound table and wherein both said inbound table and said outbound table are oriented horizontally;

c. a foldable pressure application element;

d. a foldable upper guillotine element connected to said foldable pressure application element wherein said foldable upper guillotine element comprises:

i. a supporting frame wherein said supporting frame comprises at least two pivoting pins, two vertical members and two horizontal members and wherein said two vertical members comprise two side beams with inside surfaces;

ii. a jaw cylinder located vertically at the center of said horizontal member of said supporting frame and fixed therein;

iii. a cylinder shaft;

iv. side guide assemblies vertically fixed on said inside surfaces of said two side beams;

v. an upper jaw; and vi. multiple upper cutting teeth;

wherein said multiple upper cutting teeth comprise multiple upper hydraulic floating teeth;

e. a lower guillotine element positioned below said foldable upper guillotine element;

f. a hydraulic folding device to which said foldable upper guillotine element is responsive;

g. a power generator fixed relative to said base member;

h. a power application system responsive to said power generator;

i. a towable transportation system fixed relative to said stone positioning platform;

j. a hydraulic pump responsive to said power generator;

k. a hydraulic container to which said hydraulic pump is responsive; and l. a fuel container to which said power generator is responsive;

wherein said base member comprises two lower supporting elements and wherein said two side beams of said supporting frame are pivotally attached to said two lower supporting elements through said at least two pivoting pins.

2. A foldable and transportable stone cutter system as described in claim 4 wherein said upper jaw further comprises:

a. a top beam;

b. an upper piston bar responsive to said top beam;

c. at least one upper piston within said upper piston bar; and d. an upper tooth bar responsive to said upper piston bar.

3. A foldable and transportable stone cutter system as described in claim 1 wherein said foldable upper guillotine element forms an angle with said stone positioning platform and wherein said angle is at about 90 degrees when said foldable and transportable stone cutter system is in operation.

4. A foldable and transportable stone cutter system as described in claim 3 wherein said foldable and transportable stone cutter system has a transportable position and wherein said angle is at less than about 90 degrees when said foldable and transportable stone cutter system is in said transportable position.

5. A foldable and transportable stone cutter system as described in claim 4 wherein said angle is about 10 degrees.

6. A foldable and transportable stone cutter system as described in claim 5 wherein said hydraulic folding device comprises a hydraulic folding cylinder.

7. A foldable and transportable stone cutter system as described in claim 5 wherein said lower guillotine element comprises:

a. a lower jaw; and b. multiple lower cutting teeth;

wherein said multiple lower cutting teeth comprise multiple lower hydraulic floating teeth and wherein said multiple lower hydraulic floating teeth are vertically aligned with said multiple upper hydraulic floating teeth.

8. A foldable and transportable stone cutter system as described in claim 7 wherein said lower jaw further comprises:

a. a lower beam;

b. a lower piston bar responsive to lower beam;

c. at least one lower piston within said lower piston bar; and d. a lower tooth bar responsive to said lower piston bar.

9. A foldable and transportable stone cutter system comprising:

a. a base member;

b. a stone positioning platform connected to said base member;

c. a foldable pressure application element;

d. a foldable upper guillotine element connected to said foldable pressure application element;

e. a lower guillotine element positioned below said foldable upper guillotine element;

f. a hydraulic folding device to which said foldable upper guillotine element is responsive;

g. a power generator fixed relative to said base member;

h. a power application system responsive to said power generator;

i. a towable transportation system fixed relative to said stone positioning platform wherein said towable transportation system comprises:

i. a base frame;

ii. at least two wheels;

iii. at least one tail safety light;

iv. a suspension system;

v. a brake system;

vi. a hitch element; and vii. a plurality of supporting elements attached to said base frame;

j. a hydraulic pump responsive to said power generator;

k. a hydraulic container to which said hydraulic pump is responsive; and l. a fuel container to which said power generator is responsive.

10. A foldable and transportable stone cutter system as described in claim 9 wherein said plurality of supporting elements attached to said base frame comprise a plurality of stabilizing jacks and wherein said plurality of stabilizing jacks comprise a plurality of re-positionable jacks.

11. A foldable and transportable stone cutter system as described in claim 10 wherein said towable transportation system comprises a spring suspension.

12. A foldable and transportable stone cutter system comprising:

a. a base member;

b. a stone positioning platform connected to said base member wherein said stone positioning platform comprises:

i. an inbound receiving platform for a uncut stone wherein said inbound receiving platform comprises an inbound table; and ii. an out bound receiving platform next to said inbound receiving platform for a cut stone wherein said outbound receiving platform comprises an outbound table wherein both said inbound table and said outbound table are oriented horizontally and wherein said outbound table comprises a flat piece with a flat surface;

c. a foldable pressure application element;

d. a foldable upper guillotine element connected to said foldable pressure application element wherein said foldable upper guillotine element comprises a supporting frame wherein said supporting frames comprise two vertical members and two horizontal members and wherein said two vertical members comprise two side beams with inside surfaces wherein said two horizontal members comprise two horizontal beams that are attached to said side beams at their ends wherein at least one of said two horizontal beams comprises at least two top head supporting bars wherein said at least two top head supporting bars sustain said foldable upper guillotine element when it is folded down;

e. a lower guillotine element positioned below said foldable upper guillotine element;

f. a hydraulic pressure source;

g. a hydraulic folding device responsive to said hydraulic pressure source;

h. a power application system to which said hydraulic folding device is responsive; and i. a towable transportation system fixed relative to said stone positioning platform.

13. A foldable and transportable stone cutter system as described in claim 12 wherein said foldable upper guillotine element further comprises:

a. a jaw cylinder located vertically at the center of said horizontal member of said supporting frame and fixed therein;

b. a cylinder shaft;

c. two side guide assemblies vertically fixed on said inside surfaces of said two side beams;

d. an upper jaw; and e. multiple upper cutting teeth, wherein said multiple upper cutting teeth comprise multiple upper hydraulic floating teeth.

14. A foldable and transportable stone cutter system as described in claim 13 wherein said upper jaw further comprises:

a. a top beam;

b. an upper piston bar responsive to said top beam;

c. at least one upper piston inside said upper piston bar; and d. an upper tooth bar responsive to said upper piston bar.

15. A foldable and transportable stone cutter system as described in claim 13 wherein said foldable upper guillotine element forms an angle with said stone positioning platform and wherein said angle is at about 90 degrees when said foldable and transportable stone cutter system is in operation.

16. A foldable and transportable stone cutter system as described in claim 15 wherein said foldable and transportable stone cutter system has a transportable position and wherein said angle is at less than about 90 degrees when said foldable and transportable stone cutter system is in said transportable position.

17. A foldable and transportable stone cutter system as described in claim 16 wherein said angle is at about 10 degrees.

18. A foldable and transportable stone cutter system as described in claim 17 and further comprising a hydraulic folding device wherein said hydraulic folding device comprises a hydraulic folding cylinder.

19. A foldable and transportable stone cutter system as described in claim 18 wherein said foldable upper guillotine element comprises at least one locking pin to secure said foldable upper guillotine element to one of said two lower supporting elements when said foldable and transportable stone cutter system is in operation.

20. A foldable and transportable stone cutter system as described in claim 19 wherein said foldable upper guillotine element comprises at least two locking pins to secure said foldable upper guillotine element to both said lower supporting elements when said stone cutter system is in operation.

21. A foldable and transportable stone cutter system as described in claim 20 wherein said lower guillotine element comprises:

a. a lower jaw; and b. multiple lower cutting teeth wherein said multiple lower cutting teeth comprise multiple lower hydraulic floating teeth and wherein said multiple lower hydraulic floating teeth are vertically aligned with said multiple upper hydraulic floating teeth.

22. A foldable and transportable stone cutter system as described in claim 21 wherein said lower jaw further comprises:

a. a lower tooth bar;

b. a lower piston bar;

c. at least one lower piston within said lower piston bar; and d. a lower beam.

23. A foldable and transportable stone cutter system as described in claim 22 wherein said lower jaw is located between said inbound table and said outbound table.

24. A foldable and transportable stone cutter system comprising:

a. a base member;

b. a stone positioning platform connected to said base member;

c. a foldable pressure application element;

d. a foldable upper guillotine element connected to said foldable pressure application element;

e. a lower guillotine element positioned below said foldable upper guillotine element;

f. a hydraulic pressure source;

g. a hydraulic folding device responsive to said hydraulic pressure source;

h. a power application system to which said hydraulic folding device is responsive; and i. a towable transportation system fixed relative to said stone positioning platform wherein said towable transportation system comprises:

i. a base frame;

ii. at least two wheels;

iii. at least one tail safety light;

iv. a suspension system;

v. a brake system;

vi. a hitch element; and vii. a plurality of supporting elements attached to said base frame wherein said plurality of supporting elements attached to said base frame comprise a plurality of stabilizing jacks and wherein said plurality of stabilizing jacks comprise a plurality of repositionable jacks.

25. A foldable and transportable stone cutter system as described in claim 24 wherein said plurality of stabilizing jacks comprise at least three stabilizing jacks attached at about opposite locations on said base frame.

26. A foldable and transportable stone cutter system as described in claim 25 wherein said plurality of stabilizing jacks comprise detachable jacks.

* * * * *